US007317285B2

(12) United States Patent
Iwamatsu et al.

(10) Patent No.: US 7,317,285 B2
(45) Date of Patent: Jan. 8, 2008

(54) ELECTRON EMISSION DEVICE HAVING CLEANING FUNCTION

(75) Inventors: Tadashi Iwamatsu, Nara (JP); Hiroyuki Hirakawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 137 days.

(21) Appl. No.: 10/541,878

(22) PCT Filed: Jan. 14, 2004

(86) PCT No.: PCT/JP2004/000182

§ 371 (c)(1),
(2), (4) Date: Jul. 8, 2005

(87) PCT Pub. No.: WO2004/063818

PCT Pub. Date: Jul. 29, 2004

(65) Prior Publication Data

US 2006/0152166 A1 Jul. 13, 2006

(30) Foreign Application Priority Data

Jan. 14, 2003 (JP) ..... 2003-006176

(51) Int. Cl.

| | |
|---|---|
| ***G09G 3/10*** | (2006.01) |
| ***H01J 1/46*** | (2006.01) |
| ***H01J 9/02*** | (2006.01) |
| ***H01J 9/38*** | (2006.01) |

(52) U.S. Cl. ..... 315/169.1; 313/306; 313/310; 445/59

(58) Field of Classification Search ..... 313/306, 313/310, 311; 445/72, 59; 315/160, 167, 315/169.1

See application file for complete search history.

(56) References Cited

U.S. PATENT DOCUMENTS 5,990,605 A * 11/1999 Yoshikawa et al. ..... 313/310

(Continued)

FOREIGN PATENT DOCUMENTS

JP 06-255168 9/1994

(Continued)

OTHER PUBLICATIONS

Y. Yamaguchi, et al. *Development of High Electron Source for Image Recording with Carbon Nanotube*; Japan Hardcopy 97, The Imaging Society of Japan; Jul. 1997; pp. 221-224 w/English language translation.

(Continued)

*Primary Examiner*—Thuy Vinh Tran
(74) *Attorney, Agent, or Firm*—David G. Conlin; David A. Tucker; Edwards Angell Palmer & Dodge LLP

(57) ABSTRACT

An electron emission device comprising an electron emission element (1) having a lower electrode (2), an upper electrode (5) consisting of a thin film, the surface of the upper electrode (5) being exposed to external space, and a semiconductor layer (4) formed between the lower electrode and the upper electrode, a counter electrode (21) provided to face the upper electrode (5) across the external space, a fine particle charging voltage control unit (22) for applying a voltage that charges fine particles deposited on the surface of the upper electrode (5) to between the upper electrode (5) and the lower electrode (2), and flying voltage control unit (23) for applying a voltage that sends charged fine particles flying from the surface of the upper electrode (5) to between the upper electrode (5) and the counter electrode (21), wherein the fine particle charging voltage control unit is operated to charge deposited fine particles, and the flying voltage control unit is operated to sent charged fine particles flying toward the counter electrode (21).

8 Claims, 4 Drawing Sheets

U.S. PATENT DOCUMENTS

| | | | | |
|---|---|---|---|---|
| 6,249,080 | B1 * | 6/2001 | Komoda et al. | 313/310 |
| 6,285,118 | B1 * | 9/2001 | Hatai et al. | 313/310 |
| 6,498,426 | B1 * | 12/2002 | Watabe et al. | 313/310 |
| 6,624,589 | B2 * | 9/2003 | Kitamura et al. | 315/169.3 |
| 6,720,717 | B2 * | 4/2004 | Komoda et al. | 313/310 |
| 6,765,342 | B1 * | 7/2004 | Honda et al. | 313/310 |

FOREIGN PATENT DOCUMENTS

| | | |
|---|---|---|
| JP | 08-250766 | 9/1996 |
| JP | 11-329213 | 11/1999 |
| JP | 2000-019921 | 1/2000 |
| JP | 2001-313151 | 11/2001 |
| JP | 2001-357961 | 12/2001 |
| JP | 2002-174943 | 6/2002 |
| JP | 2002-258585 | 9/2002 |
| JP | 2002-311683 | 10/2002 |
| JP | 2004-265603 | 9/2004 |
| JP | 2004-266089 | 9/2004 |

OTHER PUBLICATIONS

Y. Yamaguchi, et al. *Application of Carbon Nanotube to Electron Beam Source for Imaging*, Department of Physics and Elecronics, Osaka Prefectur University, pp. 221-224, 1997.

Y, Nakajima, et al. "*A Novel Solid-State Light-Emitting Device Based on Ballistic Electron Excitation*", Materials Research Society, 2001, vol. 638, pp. 17-22.

* cited by examiner

ELECTRON EMISSION DEVICE HAVING CLEANING FUNCTION

This application is a National Phase Application under 35 U.S.C. 371 claiming the benefit of PCT/JP04/00182 filed on Jan. 14, 2004, which has priority based on Japan Application No. 2003-006176 filed on Jan. 14, 2003.

TECHNICAL FIELD

The present invention relates to an electron emission device for emitting electrons using an electron emitter that includes a semiconductor layer. More specifically, the present invention relates to an electron emission device capable of cleaning fine particles attached to a surface of an electron emitter when operating at atmospheric pressure to charge an object.

The electron emission device according to the present invention is applicable to an electron emission device used for charging a photoconductor of an apparatus, e.g., a laser printer or a digital copying machine, which employs electrophotography.

BACKGROUND ART

As a conventional cold cathode electron emitter, there are known a Spindt type electrode, a carbon nanotube (CNT) electrode, and the like. Application of these electron emitters to the field of field emission display (FED) has been considered. Each of these electron emitters applies a voltage to an acute portion to develop a strong electric field of about 1 GV/m, and emits electrons by a tunneling current.

As an example of an idea of causing such an electron emitter to operate in the air, thereby applying the emitter to a charger or an electrostatic latent image forming apparatus, a method for forming an electrostatic latent image by causing a Spindt cold cathode to operate in the air, emitting electrons into the air, and ionizing gas molecules to generate ions serving as charged particles is disclosed in, for example, Japanese Unexamined Patent Application No. Hei 6-255168 (1994).

In addition, the result of a study of causing a carbon nanotube to operate in the air is reported in "Japan Hardcopy 97 papers", page 221, the Imaging Society of Japan. Herein, there is suggested a probability of the carbon nanotube as a charger for electrophotography or an electron beam source for forming an electrostatic latent image.

Generally, in an electrophotographic process, a surface of a photoconductor is uniformly charged, the surface of the photoconductor is selectively exposed in correspondence with an image to be formed, an exposed portion of the photoconductor is made conductive to thereby discharge charges, and charges or so-called electrostatic latent images arranged on the surface of the photoconductor in correspondence with the images are formed. Thereafter, the photoconductor is passed through a developing section having a developing sleeve that rotates while carrying charged toners on its surface and that is arranged to oppose the surface of the photoconductor, thereby selectively attaching the toners onto the surface of the photoconductor. A transfer section transfers the attached toners onto a sheet of paper. Thereafter, the photoconductor is passed through a charge elimination section that eliminates charges from the photoconductor by irradiating the photoconductor with light. The photoconductor is further passed through a cleaning section that mechanically eliminates residual toners and paper particles attached onto the surface of the photoconductor, and then charged again for next imaging. The charger that uniformly charges the photoconductor is therefore indispensable to the electrophotographic process.

However, each of these two electron emitters generates the strong electric field in the vicinity of the surface of an electron emitting section as described above. Consequently, the emitted electrons are given strong energy by the electric field, and collide against gas molecules to ionize the gas molecules.

Positive ions generated as a result of ionization of the gas molecules are accelerated in an emitter surface direction by the strong electric field, collide against one another, and cause emitter breakdown by sputtering.

As another conventional example of the cold cathode electron emitter, there are known metal insulator metal (MIM) and metal insulator semiconductor (MIS) electron emitters.

Each of these electron emitters is a surface emitter that accelerates electrons using a strong electric field (internal electric field) generated on an insulating film layer within an emitter, and emits electrons from a flat surface of the emitter. Since the electrons accelerated within the emitter are emitted, it is unnecessary to generate a strong electric field outside the emitter. Accordingly, these emitters are free from the problem of the emitter breakdown by sputtering due to ionization of gas molecules differently from the Spindt and CNT type electrodes.

However, the MIM and MIS cold cathode electron emitters have the following problem. If the MIM or MIS cold cathode electron emitter is caused to operate in the air, then fine particles such as dust are attached onto the surface of the emitter, and the surface is covered with the attached fine particles, thereby shielding electrons and reducing electron emission current.

As still another conventional example of the electron emitter, MIS electron emitters each of which accelerates electrons injected into a porous silicon substrate by an electric field, which passes the accelerated electrons through a surface metal thin film by a tunneling effect, and which emits the electrons into a vacuum space using a quantization size effect of a porous semiconductor (e.g., porous silicon) generated by a semiconductor anodic oxidation treatment are disclosed in, for example, Japanese Unexamined Patent Application No. Hei 8-250766 (1996) and "Materials Research Society Symposium Proceeding" Vol. 638.

Each of these MIS electron emitters emit the electrons accelerated by the strong electric field within the emitter similarly to the above-described MIM and MIS cold cathode electron emitters. It is therefore unnecessary to generate a strong electric field outside the emitter and the emitter is free from the problem of the emitter breakdown by the sputtering due to ionization of gas molecules.

Moreover, the cold cathode electron emitter using the porous silicon semiconductor can be advantageously manufactured by quite a simple and inexpensive fabrication method of anodic oxidation.

However, these conventional cold cathode electron emitters operated in the air have the following problem. Since fine particles such as dust are attached onto the surface of the emitter and the attached fine particles shield electrons, the electron emission current is reduced.

Generally, the surface of the MIM or MIS cold cathode electron emitter that accelerates electrons by the internal electric field generated within the emitter also functions as an upper electrode that generates the electric field within the emitter. Consequently, the surface is made of a metal thin film so that the electrons accelerated by the internal electric field can be emitted into the external space while the electrons tunnel through the metal thin film. If the metal thin film is thinner, it is easier for the accelerated electrons to tunnel through the metal thin film. This can increase a tunneling probability and a quantity of emitted electrons.

A thickness of the metal thin film that functions as both the upper electrode for generating the internal electric field and the thin film electrode for emitting the accelerated electrons is preferably several nanometers to several tens of nanometers (nm). Japanese Unexamined Patent Application No. Hei 8-250766 (1996) discloses that the thickness of the metal thin film is, for example, 15 nm.

If the fine particles such as dust are attached onto the surface of this upper electrode (metal thin film), electrons cannot be emitted. It is therefore necessary to eliminate the attached dust. In order to eliminate the dust, a contact type dust elimination method for sweeping off the dust on the surface of the upper electrode (metal thin film) using a cleaning member is normally used. However, the contact type dust elimination method using such a cleaning member has the following problem. If the metal thin film is not treated carefully, the metal thin film is damaged or, in the worst case, peeled off by friction and stress generated while the dust are being swept off.

As another measures against attachment of dust while the MIM or MIS electron emitter is caused to operate in the air, a method using gas introduction means and a particle filter for preventing fine particles from being attached onto the surface of the emitter is disclosed in, for example, Japanese Unexamined Patent Application No. 2001-313151.

However, because of use an air current, this method has problems of low ion utilization efficiency and complicated mechanism.

As described above, the conventional electron emitters are confronted with the problem of the emitter breakdown by the sputtering if the electrons are accelerated in the external space using the external electric field. In addition, the conventional electron emitters are confronted with the problem of a reduction in electron emission current resulting from the attachment of dust onto the surface of the electrode if the electrons are accelerated using the internal electric field within the emitter. Besides, the cleaning method for wiping off the metal thin film electrode on the surface of the emitter so as to eliminate the dust may possibly damage the metal thin film. Thus, if one of these conventional electron emitters is applied to an electron emission device, e.g., a laser printer or a digital copying machine, used for charging the photoconductor thereof in the air as it is, the problems of sputtering of the upper electrode itself and the attachment of dust onto the upper electrode occur. They disadvantageously make it difficult to use the electron emission device for a long period of time.

Thus, the present invention aims to solve the problem of attachment of dust when an electron emitter is caused to operate at an atmospheric pressure. The present invention also aims to provide an electron emission device, an electron emitter cleaning device, and an electron emitter cleaning method capable of stably performing charging and electrostatic latent image formation.

DISCLOSURE OF THE INVENTION

An electron emission device according to the present invention achieved to solve the conventional problems comprises: an electron emitter that includes a lower electrode, an upper electrode made of a thin film, and a semiconductor layer formed between the lower electrode and the upper electrode, a surface of the upper electrode exposed to an external space; a counter electrode that is provided to oppose the upper electrode across the external space; a fine particle charging voltage control section that applies an electron emitting voltage for accelerating electrons in the semiconductor layer, passing the electrons through the upper electrode, and emitting the electrons to the external space, or a voltage for charging fine particles attached to the surface of the upper electrode between the upper electrode and the lower electrode; and a flying voltage control section that applies, between the upper electrode and the counter electrode, a voltage for allowing the charged fine particles to fly from the surface of the upper electrode to the counter electrode.

According to this configuration, the fine particle charging voltage control section applies the voltage between the upper electrode and the lower electrode, whereby the internal electric field is generated in the semiconductor layer. The electrons are thereby accelerated, and the accelerated electrons are passed through the upper electrode made of the metal thin film by the tunneling effect and fly out to the space. Thus, the normal function as the electron emitter is exhibited.

At this time, if the fine particles attached to the surface of the upper electrode are present, the electrons charge the attached fine particles.

The flying voltage control section applies the voltage for allowing the charged fine particles to fly from the surface of the upper electrode to the counter electrode, between the upper electrode and the counter electrode. The charged fine particles are thereby electrostatically attracted toward the counter electrode.

Therefore, by charging the attached fine particles to eliminate them from the surface of the electrode by the fine particle charging voltage control section and the flying voltage control section using this characteristic if necessary, the fine particles on the metal thin film on the surface of the electron emitter can be cleaned in a non-contact manner. In addition, the problem of damaging and peeling off the metal thin film due to the friction and stress during the cleaning can be avoided.

As the lower electrode, an n type silicon substrate having an ohmic electrode (back surface electrode) formed on its back surface (in which case the ohmic electrode and the n type silicon substrate function as the lower electrode), or an electrode formed on a glass substrate can be employed.

A material for the electrode is preferably metal. However, the material for the electrode is not limited to a specific one as long as the material is excellent in conduction and may be a metal oxide or the like.

Further, a material for the upper electrode made of the thin film is preferably gold. Alternatively, metal such as aluminum, tungsten, nickel, platinum, chromium or titanium or a metal oxide such as ITO may be used. A thickness of the metal thin film is preferably several to several tens of nanometers so that the accelerated electrons can fly out by the tunneling effect.

As for the semiconductor layer formed between the lower electrode and the upper electrode, it is necessary to generate the internal electric field in the semiconductor layer to accelerate the electrons when the voltage is applied between the lower electrode and the upper electrode.

Such a semiconductor layer is preferably, for example, an undoped porous polysilicon semiconductor layer.

The counter electrode is fixedly arranged to oppose the upper electrode across an interval (external space). In order to prevent the positional relationship between the counter electrode and the upper electrode from varying, the counter electrode is formed out of a rigid material such as a metal plate.

The counter electrode is not always provided separately as an electrode dedicated to the electron emission device. If the electron emission device is used for, for example, charging the photoconductor of the apparatus employing electrophotography, the photoconductor arranged to oppose the upper electrode may be also used as the counter electrode if necessary.

Further, the fine particle charging voltage control section and the flying voltage control section can employ constant-voltage power sources an output voltage of each of which can be set to a desired value, respectively.

With the above-described configuration, a semiconductive layer or an insulating layer may be formed on a surface of the counter electrode.

If the fine particles attached to the surface of the electron emitter are insulating fine particles, the attached fine particles that are negatively charged by causing the fine particle charging voltage control section to operate are attracted toward the external electric field generated by causing the flying voltage control section to operate and moved to the counter electrode. After being moved to the counter electrode, the fine particles are held on the counter electrode irrespective of the conduction of the surface of the counter electrode. In this case, no problem occurs since the fine particles are held thereon.

However, if the attached fine particles are semiconductive or conductive and the surface of the counter electrode is conductive, the following disadvantages occur. Positive charges are injected into the charged fine particles moved to the counter electrode, and the fine particles positively charged by the injected charges are moved toward the surface of the electron emitter again by the same external electric field.

Therefore, the surface of the counter electrode may be formed from the semiconductive or insulating material, whereby the injection of the positive charges into the conductive or semiconductive fine particles moved to the counter electrode can be prevented. It is therefore possible to prevent the fine particles from being moved again toward the surface of the electron emitter.

The flying voltage control section may apply a pulsed voltage so that the counter electrode has a positive potential relative to the upper electrode.

According to this configuration, the fine particles attached to the surface of the upper electrode of the electron emitter are negatively charged by driving the fine particle charging voltage control section. By applying the positive voltage to the counter electrode by driving the flying voltage control section, the attached fine particles are electrostatically attracted to the counter electrode. At this time, by applying the pulsed voltage to the counter electrode, an electrostatic attractive force is generated so as to apply an impact to the charged fine particles. As a result, the charged fine particles are easily separated from the surface, and the fine particles can be efficiently eliminated.

If the pulsed voltage is applied by repeating a pulsed voltage waveform a plurality of times, a plurality of impact forces are applied to the fine particles, whereby the fine particles can be eliminated more efficiently.

The flying voltage control section may operate a control to apply the voltage having a first voltage value to the external space between the upper electrode and the counter electrode. After the fine particle charging voltage control section applies a predetermined voltage between the upper electrode and the lower electrode to charge the fine particles attached to the surface of the upper electrode, the flying voltage control section may operate a control to apply the voltage having a second voltage value higher than the first voltage value, the second voltage value having such a magnitude that allows the charged fine particles to fly from the upper electrode to the counter electrode and that atmospheric discharge does not occur, and the fine particle charging voltage control section may operate a control to either apply a voltage having an opposite polarity to a polarity of the electron emitting voltage or apply no voltage between the upper electrode and the lower electrode, thereby allowing the charged fine particles to fly from the surface of the upper electrode to the counter electrode.

"Flying the fine particles from the surface of the upper electrode to the counter electrode" means eliminating the fine particles attached to the surface of the upper electrode from the electron emitter and cleaning them. The fine particles attached onto the upper electrode include dust such as toners and paper particles.

According to this configuration, a weak positive potential is applied to the external space between the counter electrode and the upper electrode when the electron emitter is driven to operate and the fine particle charging voltage control section charges the attached fine particles, thereby suppressing the counter electrode from being excessively negatively charged up. When the attached fine particles are caused to fly, the voltage opposite in polarity to the electron emitting voltage is applied between the upper electrode and the lower electrode or no voltage is applied therebetween. The electron emission is thereby stopped, a state in which the atmospheric discharge hardly occurs in the external space is set, and the charged fine particles are separated from the upper electrode.

Alternatively, the flying voltage control section may be constructed to be capable of setting the polarity of the voltage applied between the upper electrode and the counter electrode to either positive or negative.

The flying voltage control section may operate a control to apply the voltage having a second voltage value higher than the first voltage value, the second voltage value having such a magnitude that allows the charged fine particles to fly from the upper electrode to the counter electrode and atmospheric discharge does not occur.

The fine particle charging voltage control section may operate a control to either apply a voltage having an opposite polarity to a polarity of the electron emitting voltage or apply no voltage between the upper electrode and the lower electrode, thereby allowing the charged fine particles to fly from the surface of the upper electrode to the counter electrode.

According to this configuration, if the fine particles attached to the surface of the electron emitter are insulating fine particles that are negatively charged, the fine particles are eliminated by applying the positive voltage to the counter electrode to thereby generate the electrostatic attractive force. If the fine particles attached to the surface of the electron emitter are insulating fine particles that are positively charged, the fine particles are eliminated by applying the negative voltage to the counter electrode to thereby generate the electrostatic attractive force. If the fine particles attached to the surface of the electron emitter are conductive fine particles and the positive voltage is applied to the counter electrode, the fine particles are negatively charged by the induction charging and eliminated by the electrostatic attractive force. If the fine particles attached to the surface of the electron emitter are conductive fine particles and the negative voltage is applied to the counter electrode, the fine particles are positively charged by the induction charging and eliminated by the electrostatic attractive force. As described above, whether the fine particles are insulating fine particles or conductive fine particles, the electrostatic attractive force effectively acts on the fine particles having various electric characteristics and the fine particles are moved from the upper electrode to the counter electrode. The fine particles can be thereby eliminated.

Further, after the fine particles are moved to the counter electrode, it is possible to prevent positive or negative charges from being injected into the conductive or semiconductive fine particles moved to the counter electrode if the surface of the counter electrode is formed from the semiconductive or insulating material. It is therefore possible to prevent the fine particles from being moved and returned again to the surface of the electron emitter.

In this case, it is desirable that the semiconductor layer is a porous silicon semiconductor layer obtained by making part of or all of polysilicon porous.

The electron emitter formed by making the polysilicon film porous has improved thermal stability, so that the electron emitter can perform the stable electron emitting operation even in the vacuum or the air.

Further, the electrons are emitted from a polysilicon grain boundary. Consequently, the fine particles attached to the surface of the metal thin film are turned into a non-uniform charged state, a moment force acts on the fine particles by the external electric field, and cleaning performance can be enhanced.

The flying voltage control section may apply a voltage between the upper electrode and the counter electrode when the electrons are not emitted from the elevtron emitter so that the surface of the upper electrode of the electron emitter is negative.

According to this configuration, the external electric field is applied such that the upper electrode on the surface of the electron emitter is negative when the electron emitter does not operate, whereby the attachment of the insulating fine particles having strong negative charges, which are difficult to clean, from being attached to the surface of the electron emitter. The long life of the electron emitter can be thereby ensured.

The electron emission device may be used for a laser printer or a digital copying machine.

According to another aspect of the present invention, there is provided an electron emitter cleaning device for eliminating fine particles attached to a surface of an upper electrode made of a thin film of a surface emission type electron emitter that emits electrons from the surface of the upper electrode. Herein, the electron emitter cleaning device comprises: a counter electrode that is provided to oppose the surface of the upper electrode across an external space; a fine particle charging voltage control section that drives the electron emitter to apply a voltage for charging fine particles attached to the surface of the upper electrode; and a flying voltage control section that applies, between the upper electrode and the counter electrode, a voltage for allowing the charged fine particles to fly from the surface of the upper electrode to the counter electrode.

In this case, the surface emission type electron emitter may include a lower electrode, the upper electrode made of the thin film, and a semiconductor layer formed between the lower electrode and the upper electrode. The fine particle charging control section may apply the voltage for charging the fine particles between the upper electrode and the lower electrode.

According to still another aspect of the present invention, there is provided an electron emitter cleaning method for eliminating fine particles attached to a surface of an upper electrode of a surface emission type electron emitter that emits electrons from the surface of the upper electrode made of a metal thin film. Herein, the electron emitter cleaning method comprises the steps of: providing a counter electrode to oppose the surface of the upper electrode across the external space; driving the electron emitter to thereby charge the fine particles attached to the surface of the upper electrode; and applying, between the upper electrode and the counter electrode, a voltage for allowing the charged fine particles to fly from the surface of the upper electrode to the counter electrode.

BEST MODE FOR CARRYING OUT THE INVENTION

Embodiments of the present invention will be described hereinafter with reference to the drawings. A structure of an electron emitter (main body) to which the present invention can be applied will first be described, and a structure of an electron emission device or an electron emitter cleaning device using this electron emission device will next be described.

Structure of Electron Emitter

Figure 1:
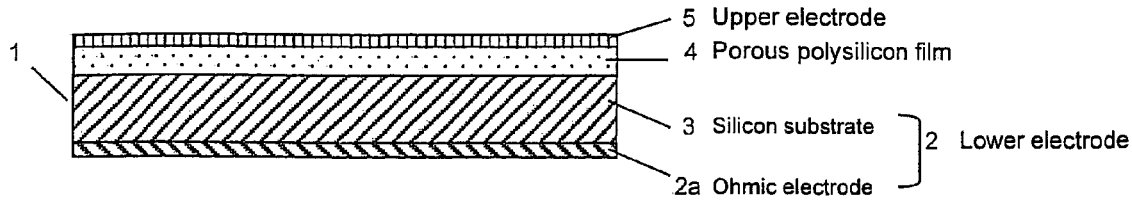
FIG. 1 depicts a configuration of an electron emitter used in an electron emission device according to one embodiment of the present invention.

FIG. 1 depicts a configuration of one embodiment of an electron emitter to which the present invention can be applied.

This electron emitter 1 is configured so that a porous polysilicon film 4 (semiconductor layer) is formed on an n type silicon substrate 3 having an ohmic electrode (back surface electrode) 2*a* formed thereon (in which case the ohmic electrode 2*a* and the n type silicon substrate 3 function as a lower electrode 2), and so that a gold electrode thin film functioning as an upper electrode 5 is formed on a surface of the porous polysilicon film 4. The ohmic electrode 2*a* and the n type silicon substrate 3 are connected to each other so as to form an ohmic contact therebetween.

The n type silicon substrate 3 acts not only as an electrode for injecting electrons into the porous polysilicon layer 4 serving as the semiconductor layer but also as a support member of the electron emitter that constitutes the present invention.

The porous polysilicon layer 4 on the n type silicon substrate 3 is fabricated by the following method.

An undoped polysilicon layer having a thickness of about 1.5 μm is formed on a surface of the n type silicon substrate 3 by LPCVD (Low Pressure Chemical Vapor Deposition).

A constant-current anodic oxidation treatment is conducted within a mixture solution in which a 50 wt % of hydrofluoric aqueous solution and ethanol are mixed together by 1:1, with the polysilicon layer serving as a positive electrode and a platinum electrode provided separately from the polysilicon layer as a negative electrode, thereby making a part of or all of the polysilicon layer porous.

During the anodic oxidation, a surface of the polysilicon layer is irradiated with light by a tungsten lamp of 500 W. This is intended to generate electron-hole pairs and accelerate an anodic oxidation reaction by irradiating the surface of the silicon substrate with the light.

Finally, the porous polysilicon layer is subjected to a rapid thermal oxidation (RTO) treatment at about 900° C., thereby forming an oxide film.

A gold electrode thin film serving as the upper electrode 5 is formed on the surface of the porous polysilicon layer 4 thus treated by either evaporation or sputtering, thereby forming the electron emitter 1 configured as shown in FIG. 1.

Figure 2:
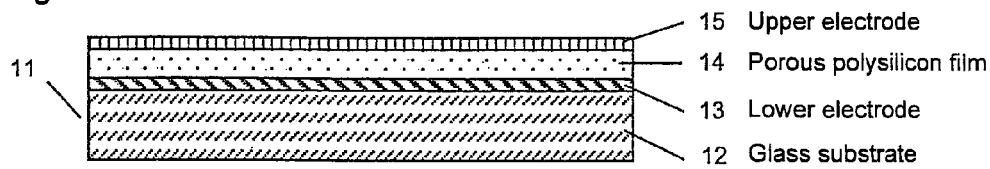
FIG. 2 depicts a configuration of another electron emitter used in the electron emission device according to one embodiment of the present invention.

FIG. 2 depicts a configuration of another embodiment of the electron emitter to which the present invention can be applied. This electron emitter 11 is configured so that a lower electrode 13 is formed on a surface of a glass substrate 12, a porous polysilicon layer 14 (semiconductor layer) is formed on the lower electrode 13, and so that a gold electrode thin film serving as an upper electrode 15 is formed on the porous polysilicon layer 14. In this case, the glass substrate serves as a support member for the electron emitter.

As a material for the lower electrode 13 on the glass substrate 12, a metal such as aluminum, tungsten, gold, nickel, platinum, chromium or titanium, or a metal oxide such as ITO can be used. The lower electrode 13 is formed by either evaporation or sputtering.

The porous polysilicon layer 14 formed above the surface of the glass substrate 12 on which the lower electrode 13 is formed is fabricated by the following method similarly to the electron emitter shown in FIG. 1. An undoped polysilicon layer (which is transformed to the porous polysilicon layer 14 later) having a thickness of about 1.5 μm is formed on the surface of the glass substrate 12 on which the lower electrode 13 is formed by the LPCVD.

A constant-current anodic oxidation treatment is conducted within a mixture solution in which a 50 wt % of hydrofluoric aqueous solution and ethanol are mixed together by 1:1, with the polysilicon layer serving as a positive electrode and a platinum electrode provided separately from the polysilicon layer serving as a negative electrode, thereby making a part of or all of the polysilicon layer porous. Similarly to the embodiment shown in FIG. 1, during the anodic oxidation, a surface of the polysilicon layer is irradiated with light by the tungsten lamp of 500 W.

Finally, an electrochemical oxidation (ECO) treatment is conducted within an about 10% dilute sulfuric acid by applying a constant current, with the polysilicon layer serving as the positive electrode and the platinum electrode serving as the negative electrode, thereby forming an oxide film.

The gold electrode thin film 15 is formed on the surface of the porous polysilicon layer 14 thus treated by either evaporation or sputtering. A material for this electrode thin film may be metal such as aluminum, tungsten, nickel, platinum, chromium or titanium or a metal oxide such as ITO besides gold.

With this ECO-based fabrication method, a process temperature is lower than that with the RTO-based fabrication method. Therefore, a restriction on available substrate materials is relaxed and the glass substrate can be used. Besides, the porous polysilicon layer 14 can be oxidized by the same wet treatment subsequent to the anodic oxidation treatment. The fabrication method can therefore simplify the process as compared with the RTO-based fabrication method.

Structure of Electron Emission Device

Figure 3:
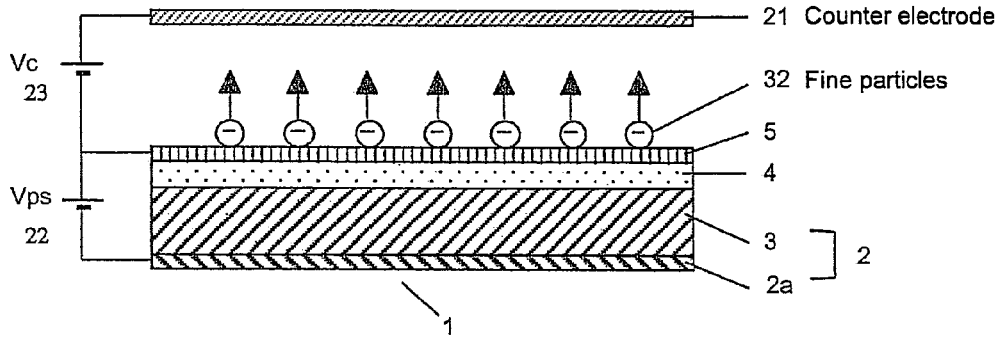
FIG. 3 depicts a configuration of the electron emission device according to one embodiment of the present invention.

FIG. 3 depicts a configuration of an electron emission device according to one embodiment of the present invention. Specifically, FIG. 3 depicts the electron emission device using the electron emitter 1 shown in FIG. 1.

In this embodiment, the electron emitter 1 shown in FIG. 1 is used. Needless to say, the electron emitter 1 may be replaced by the electron emitter 11 shown in FIG. 2.

In this electron emission device 20, a counter electrode 21 is arranged at an opposite position to the upper electrode 5 of the electron emitter 1 across a space. A distance between the upper electrode 5 and the counter electrode 21 is about 1 mm. Some apparatuses using the electron emission device 20 can employ a member already disposed on the apparatus as the counter electrode 21. For example, if the electron emission device 20 is used for charging a photoconductor of a laser printer or a digital copying machine employing the electrophotography, the photoconductor is arranged to oppose the electron emitter. This photoconductor can be therefore also used as the counter electrode.

A constant-voltage power source 22 for applying a direct current (DC) voltage Vps between the ohmic electrode 2*a* and the upper electrode 5, and a constant-voltage power source 23 for applying a DC voltage Vc between the upper electrode 5 and the counter electrode 21 are connected to the respective electrodes.

The constant-voltage power source 22, which generates an internal electric field in the porous polysilicon layer 4 to thereby accelerate electrons, can apply a voltage of several to several tens of volts as Vps. The constant-voltage power source 23, which projects out charged particles attached onto the upper electrode 5 to the counter electrode 21, can apply a voltage of several tens to several hundreds of volts as Vc. The constant-voltage power source 23 is configured to have a variable voltage polarity, so that the polarity can be switched according to a property of the attached particles (whether the particles are positively charged or negatively charged).

Alternatively, from other viewpoints, the structure of this electron emission device 20 can be regarded as an electron emitter cleaning device having a cleaning device added to the electron emitter 1.

An operation of the electron emission device according to the present invention will next be described. To describe the operation of the electron emission device according to the present invention, a basic operation characteristic of the electron emitter, a dust attachment phenomenon while the emitter is used, and an attached dust cleaning operation will be described in this order.

Basic Operation Characteristic of Electron Emitter

Figure 4:
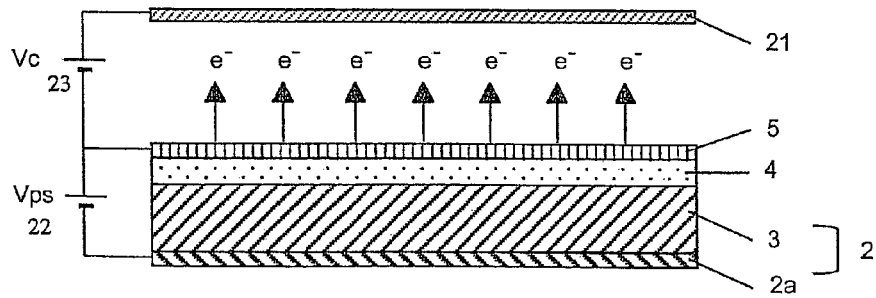
FIG. 4 explains a state of driving the electron emission device according to one embodiment of the present invention.
Figure 5:
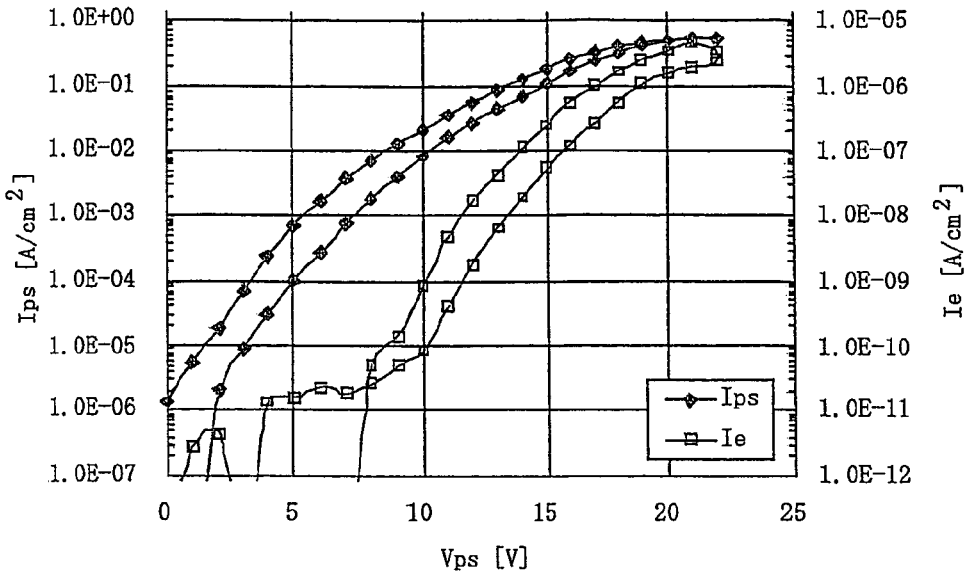
FIG. 5 depicts a measurement result of a current-to-voltage characteristic of the electron emitter according to the present invention.

FIG. 4 explains a state of driving the electron emitter 1 described above. FIG. 5 depicts a result of measuring a current-to-voltage characteristic of the electron emitter 1. As shown in FIG. 4, the counter electrode (collector electrode) 21 is arranged at the opposite position to the upper electrode 5 of the electron emitter 1. The DC voltage Vps is applied between the upper electrode 5 (serving as the positive electrode) and the ohmic electrode (serving as the negative electrode). The DC voltage Vc of 100 V is applied between the counter electrode (collector electrode) 21 and the upper electrode 5. The electron emitter 1 is thereby driven.

FIG. 5 depicts the result of measuring a diode current Ips carried between the upper electrode 5 and the lower electrode 2 and an emission electrode Ie carried to the counter electrode 21 by the electrons radiated from the upper electrode 5 and negative ions present in the air if the distance between the upper electrode 5 and the collector electrode 21 is 1 mm.

In FIG. 5, a horizontal axis indicates a value of the DC voltage Vps applied to the electron emitter, and a vertical axis indicates a value of a current density in log scale. Among plotted currents, symbol ♦ denotes the diode current Ips and denotes the electron emission current Ie.

According to the result of the electron emitting experiment shown in FIG. 5, an amount of the emitted electron current Ie of 4.5 $\mu A/cm^2$ is observed even in the air when the voltage Vps applied to the emitter is 21 V. Most of this current is considered to result from the electrons accelerated by the porous polysilicon layer 4, emitted while tunneling through the upper electrode 5, adhering to gas molecules in the air, and carried up to the counter electrode 21 in a negative ion state.

The current amount of 4.5 $\mu A/cm^2$ is a current amount applicable to charging of the photoconductor of the apparatus, e.g., a laser printer or a digital copying machine, employing the electrophotography. Such a charging device has a configuration in which the counter electrode (collector electrode) 21 is replaced by the photoconductor in FIG. 4.

However, if the photoconductor of the apparatus employing the electrophotography is to be charged by the charging device configured as described above, dust such as toners which are insulating particles of about 7 μm and conductive paper particles are attached to the upper electrode 5.

As a result of conducting the electron emission experiment in an atmosphere in which the dust such as toners are present, it is confirmed that the emission current Ie is reduced substantially proportionally to a ratio of an area by which the dust are attached to the upper electrode 5.

This indicates that it is necessary to eliminate the dust on the upper electrode 5 by some way or other so as to continuously keep the emission current Ie to be the initial value without reduction.

Meanwhile, the metal thin film for forming the upper electrode 5 of the electron emitter according to the present invention is configured to have a very small thickness of several to several tens of nanometers so as to be able to effectively emit electrons generated within the electron emitter 1. For this reason, if fine particles such as the dust attached onto this upper electrode 5 are to be wiped off using a contact type cleaning member, then the metal thin film that constitutes the upper electrode 5 may possibly be damaged or peeled off by friction and stress applied while wiping off the dust.

Attachment of Dust

Figure 6:
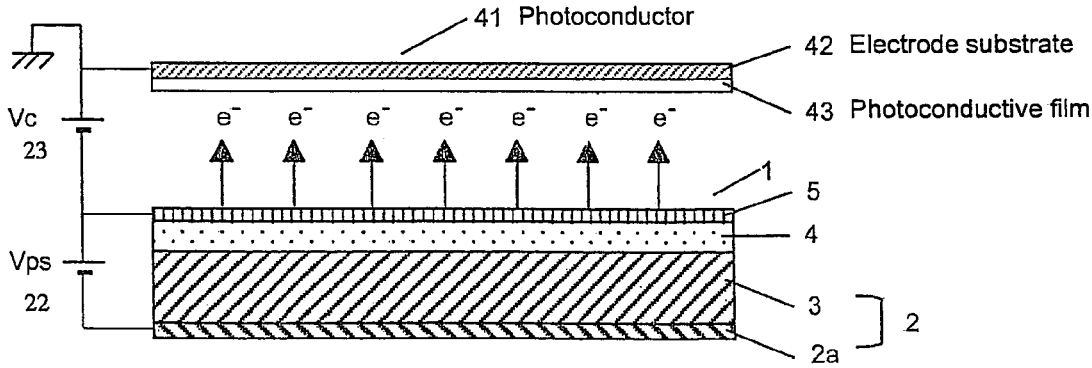
FIG. 6 explains a photoconductor charging experiment during an electrophotographic process.

FIG. 6 schematically depicts a state when a photoconductor charging experiment is conducted using the electron emitter 1 in an actual photoelectric process. A result of contamination by the dust and the like will be described.

The electron emitter 1 is equal in shape to that shown in FIG. 1, and configured by the lower electrode 2 (the ohmic electrode 2*a* and the n type silicon substrate 3), the porous polysilicon film 4 (semiconductor layer), and the upper electrode (metal thin film) 5.

In the electron emission device used for charging the photoconductor of the apparatus employing the electrophotography, a photoconductor 41 configured by an electrode substrate 42 (conductive material) and a photosensitive film 43 (material having high resistance in the dark) is arranged at an opposed position to the upper electrode 5 of the electron emitter 1. A space (external space) positioned between the upper electrode 5 and the photoconductor 41 will be referred to as "charged space" hereinafter.

The distance between the upper electrode 5 of the electron emitter 1 and the photoconductor 41 is 1 mm, the DC voltage (collector voltage) Vc applied between the upper electrode 5 and the electrode substrate 42 of the photoconductor 41 is 800 V, and the DC voltage (emitter applied voltage) Vps applied between the upper electrode 5 and the ohmic electrode 2*a* is 20 V. Under these conditions, the photoconductor 41 is charged.

While this charging operation is performed, a strong electric field is generated in the charged space between the upper electrode 5 and the photoconductor 41, and electrons emitted while tunneling through the upper electrode 5 are efficiently carried to the photoconductor 41. Since this electron emission is performed in the air, it is considered that most of the emitted electrons are attached to gas molecules in the air and carried as negative ions.

After repeatedly conducting this charging experiment, it is clear that dust are attached to the upper electrode 5 of the electron emitter 1 while the charging operation is performed. As a result of analyzing the attached dust, they mainly consist of toners and paper particles. The toners have an average specific charge of about −10 to −15 μc/g in a developing section and are negatively charged. However, this value is only an average and positively charged toners and uncharged toners are present although a probability of the presence thereof is quite low. Further, in the electrophotographic process, the toners are constrained on the developing sleeve and the photoconductor by an electrostatic force in the developing section and the like. However, sine this electrostatic force is weak, toners having low specific charge and uncharged toners tend to be entrained and some of them, though only slightly, float on a charging section and the other sections for carrying out the electrophotographic process.

It is therefore considered that floating toners charged slightly positively, which enter the charged space during the charging operation, are attracted by the strong electric field present in the charged space and attached onto the upper electrode 5. The same thing is true for the paper particles. It is considered that floating paper particles charged slightly positively are attracted by the strong electric field present in the charged space during the charging operation and attached onto the upper electrode 5.

The dust (floating toners and paper particles) attached once onto the upper electrode 5 of the electron emitter 1 lose their charges with the passage of time. Surface resistivity of the paper changes quite sensitively to humidity. Since the surface resistivity of the paper is normally within a range of $10^9$ to $10^{13}$ Ω, the dust lose their charges relatively soon. It is confirmed that the paper particles lose their charges within about one second in a paper particle induction charging experiment although the time is only a reference value. Since the toners are higher in resistance (insulating property) than the paper particles, it takes more time for the toners to lose their charges.

As described above, the charge quantity of the dust attached onto the upper electrode 5 is made small because it is originally small and the dust lose their charges with the passage of time.

Principle of Cleaning

The principle of cleaning operation for cleaning dust attached onto the upper electrode 5 of the electron emitter 1 will be described with reference to the drawings.

The voltage Vc is applied between the upper electrode 5 of the electron emitter 1 and the counter electrode 21.

The relationship between a charge quantity qt of dust and an image force Fi that is an adhesive force will be described. The image force Fi that is a force acting on the upper electrode 5 in an attraction direction is understood to be generated by charges of opposite polarities concentrating on the surface of the electrode and attracting each other when charged fine particles are attached onto the surface of the electrode. If the fine particles are spherical, the image force Fi is expressed as follows.

$$Fi = \frac{qt^2}{4\pi\varepsilon \cdot (2rt)^2} \tag{1}$$

Herein, ∈ denotes a dielectric constant and rt denotes a radius of a fine particle.

As evident from the Equation (1), the image force Fi is proportional to a square of the charge quantity qt of the fine particle.

In addition, if a positive voltage V is applied to the counter electrode 21 arranged to be apart from the upper electrode 5 by a distance d, an electrostatic force Fe acting on a direction in which the fine particles are peeled off is expressed as follows.

$$Fe = qt \cdot E \tag{2}$$

Herein, E denotes an electric field generated between the upper electrode 5 and the counter electrode 21 and calculated as "E=V/d=Vc/d". As evident from the Equation (2), the electrostatic force Fe is proportional to a first power of the charge quantity qt of the fine particle.

Figure 7:
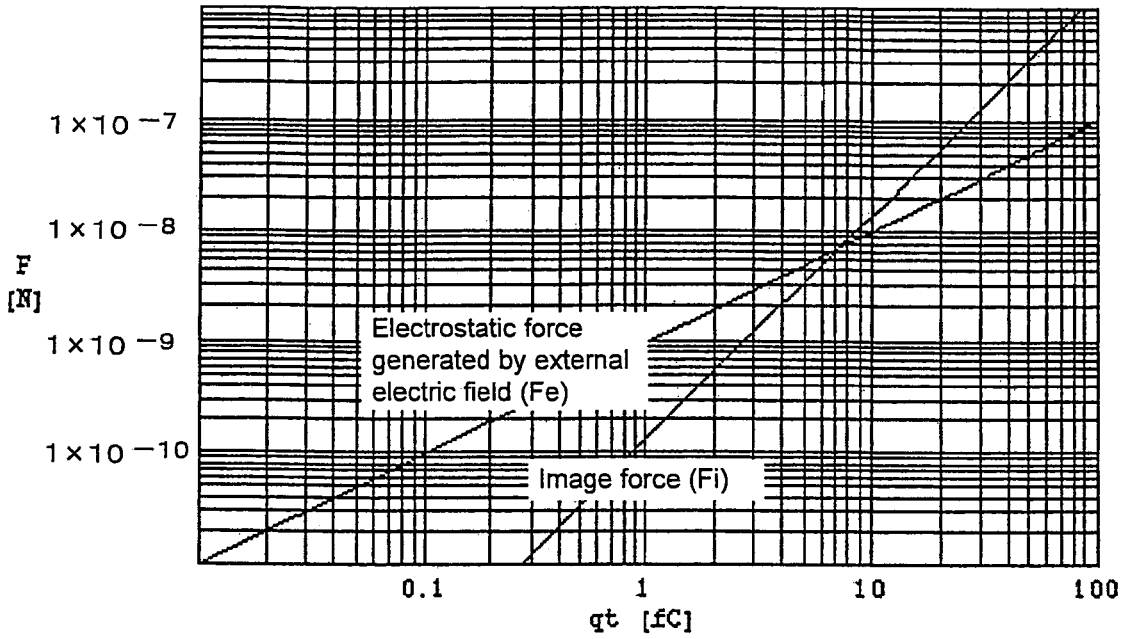
FIG. 7 explains a result of calculating the relationship between an image force Fi and an electrostatic force Fe generated by an external electric field.

FIG. 7 depicts a result of calculating the relationship between the image force Fi and the electrostatic force Fe by the external electric field while assuming that a diameter (2rt) of a fine particle is 8 μm and that an intensity E of the external electric field is $10^6$ V/m.

According to this calculation result, in a region in which the charge quantity qt is small, e.g., "qt≦7fc" [fc: femtocoulomb] ($7\times10^{-15}$ C), the electrostatic force Fe by the external electric field exceeds the image force Fi. This indicates that the dust can be cleaned by the external electric field.

Actually, however, apart from the image force by the charge quantity qt, a van der Waals' force known as an attractive force between two molecules acts on the fine particles. Consequently, if the charge quantity qt is too small, the absolute value of the electrostatic force Fe for peeling off the fine particles by the external electric field is small and falls below the van der Waals' force Fv. As a result, the dust cannot be cleaned.

On the other hand, in a region in which the charge quantity is large, the electrostatic force Fe for peeling off the fine particles by the external electric field falls below the image force Fi. This indicates that it is difficult or impossible to clean the dust by the external electric field. However, if the external electric field intensity E is i, then the electrostatic force Fe by the external electric field is increased and a line that shows the electrostatic force Fe is shifted in an upward direction in FIG. 7. As a result, "Fe>Fi" is satisfied, that is, the cleanable region can be widened.

If the charge polarity of the fine particles is positive, then the electrostatic force Fe by the external electric field is equal in direction to the image force Fi and acts on the direction of the upper electrode 5. The dust cannot be therefore cleaned. In this case, by setting the charge polarity of the fine particle negative or setting the polarity direction of the external electric field to an opposite direction, the dust can be cleaned.

First Embodiment

By way of example, it is assumed that the toners that are insulating fine particles each having a diameter of 8 μm are attached to the upper electrode 5. If a specific charge (charge quantity per unit mass) of the toners is an ordinary value of −10 μC/g and that a specific gravity of the toners is 1 g/cm$^3$, the charge quantity qt of one toner is $-2.68\times10^{-15}$ C.

If this toner charge quantity qt is assigned to the Equation (1), the image force Fi is 1.0 nN. In addition, if the external electric field intensity is $10^6$ V/m, the electrostatic force Fe by the external electric field is 2.7 nN.

In this example, "Fi<Fe" is satisfied, i.e., the force for peeling off the fine particles by the external electric field is higher than the force for attaching the fine particles onto the upper electrode 5 by the image force. It is therefore possible to clean the fine particles on the upper electrode 5.

During the above-described electrophotographic process, to conduct the photoconductor charging experiment, the DC voltage (collector voltage) Vc of 100 V is applied between the upper electrode 5 of the electron emitter 1 onto which the dust are attached and the counter electrode 21 (at the distance d of 1 mm therebetween).

At this time, an electric field of $10^5$ V/m is generated in the space between the upper electrode 5 and the counter electrode 21, so that dust having weak negative charges are attracted toward the counter electrode 31 and eliminated from the electron emitter 1.

Next, if the DC voltage Vps of 20 V is applied between the upper electrode 5 of the electron emitter 1 and the ohmic electrode 2*a*, emission of electrons from the electron emitter 1 is started. In addition, the fine particles 32 present on the upper electrode 5 are negatively charged by the emitted electrons or negative ions generated by attaching the electrons to the gas molecules. As described above, the initial charge polarity of the charged fine particles 32 attached onto the upper electrode are considered to be almost positive. However, irrespective of this initial polarity, the fine particles 32 are gradually charged negatively.

While the negative charges of the fine particles 32 are increased, the charge quantity qt in the Equation (2) is increased and the electrostatic force Fe by the external electric field is increased accordingly (see FIG. 7). The moment a magnitude of the electrostatic force Fe exceeds that of the van der Waals' force Fv, the fine particles 32 are attracted toward the counter electrode 31 and eliminated from the electron emitter 1.

Namely, by driving the electron emitter 1, negatively charging the fine particles 32, and setting a state that satisfies "Fv<Fi<Fe" or "Fi<Fv<Fe" by the force of the electric field generated by the counter electrode 31, the fine particles 32 are cleaned.

If the fine particles exhibit very high van der Waals' force Fv and increasingly negatively charged without cleaning the fine particles 32, the image force Fi is increased this time. If the state of "Fi<Fv<Fe" is not present and the state turns into a state of "Fe<Fi<Fv" in the process of increasing the charge quantity qt, such fine particles cannot be eliminated any longer.

Considering this, for the fine particles having the high van der Waals' force Fv, the external electric field intensity E may be increased. This is because by increasing the external electric field intensity E, the electrostatic force Fe that is the elimination force is increased with the image force Fi that is the adhesion force set constant. That is, by increasing the external electric field intensity E, the state of either "Fi<Fe<Fv" or "Fe<Fi<Fv" can be changed to the state in which only the electrostatic force Fe is increased. By thus setting the state of "Fi<Fv<Fe", the fine particles can be eliminated from the electron emitter 1. Conversely, if the external electric field intensity E is set extremely high, atmospheric discharge that is dielectric breakdown of the air occurs, with the result that the electron emitter 1 may possibly be broken down.

It is therefore preferable to control the space electric field intensity E generated between the upper electrode 5 and the counter electrode 21 to be equal to or lower than 3 MV/m so as to avoid the discharge phenomenon.

The discharge phenomenon caused by the dielectric breakdown is an electron avalanche (cumulative multiplication of electrons and ions in an avalanche fashion) phenomenon. While the electron emitting operation is performed, the number of electrons and negative ions increases. Consequently, even at the electric field intensity at which the discharge phenomenon does not normally occur, the discharge phenomenon tends to occur. Namely, at a far lower electric field intensity than the electric field intensity (3 MV/m) at which the discharge phenomenon can be normally avoided, the discharge phenomenon starts.

To meet this contradictory requirements about the electric field intensity, i.e., to meet a requirement that the electric field intensity be increased so as to efficiently clean the fine particles and a requirement the electric field intensity be lessened so as to avoid the discharge phenomenon, the following control is operated.

When the electron emitter 1 is driven to negatively charge the fine particles attached onto the upper electrode 5, the intensity of the electric field in the external space is minimized. On the other hand, when the fine particles are eliminated toward the counter electrode 21 by the electrostatic force, no electrons are emitted from the electron emitter 1 and the intensity of the electric field in the external space is set as high as possible. By applying the voltage to the electron emitter 1 and the counter electrode 21 at such timings, the discharge phenomenon and the breakdown of the electron emitter are avoided.

Furthermore, by applying a pulsed voltage between the upper electrode 5 and the counter electrode 21 (turning on and off the voltage Vc), the electric field intensity is changed in a pulsed fashion and an impact force is generated on the charged particles. It is therefore possible to eliminate the fine particles from the electron emitter 1 more effectively.

Moreover, since the discharge phenomenon due to the dielectric breakdown is the electron avalanche (cumulative multiplication of electrons and ions in an avalanche fashion) phenomenon, it takes some time to generate the phenomenon. If a pulse width of the applied voltage is set smaller than the time necessary for the avalanche, then the discharge phenomenon and the breakdown of the electron emitter can be avoided.

Second Embodiment

Figure 8:
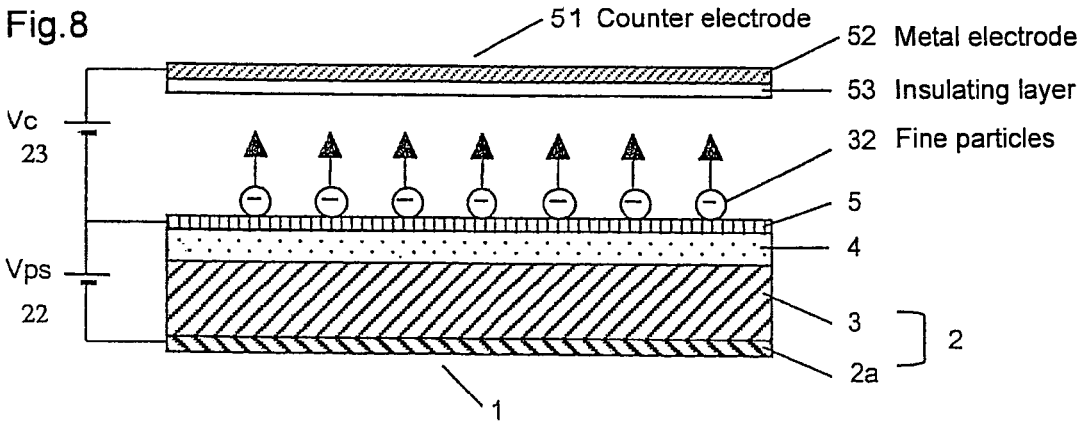
FIG. 8 depicts a configuration of an electron emission device according to another embodiment of the present invention.

FIG. 8 depicts a configuration of an electron emission device according to another embodiment of the present invention. In this embodiment, an instance in which conductive fine particles 32 are attached onto the upper electrode 5 of the electron emitter element 1 will be described.

The electron emission device in this embodiment is equivalent in structure to the device configured so that the electron emitter and the photoconductor for the electrophotographic process are arranged to oppose each other as already described with reference to FIG. 6.

Namely, the electron emitter 1 is equal in shape to that shown in FIG. 1, and configured by the lower electrode 2 (ohmic electrode 2*a* and n type silicon substrate 3), the porous polysilicon film 4 (semiconductor layer), and the upper electrode (metal thin film) 5.

A counter electrode 51 is arranged at an opposite position to the upper electrode 5 of this electron emitter 1, and the DC voltage (collector voltage) Vc is applied between the upper electrode 5 and the counter electrode 51. This counter electrode 51 is configured by a metal electrode 52 and an insulating layer 53.

If the counter electrode 51 is configured only by the metal electrode as shown in FIG. 3 and conductive fine particles 32 apart from the upper electrode 5 of the electron emitter 1 are attached to the counter electrode 51, positive charges are injected into the fine particles 32 by induction charging. As a result, an undesirable phenomenon that the fine particles 32 are attracted toward the negative electrode and returned again to the upper electrode 5 occurs.

Figure 9:
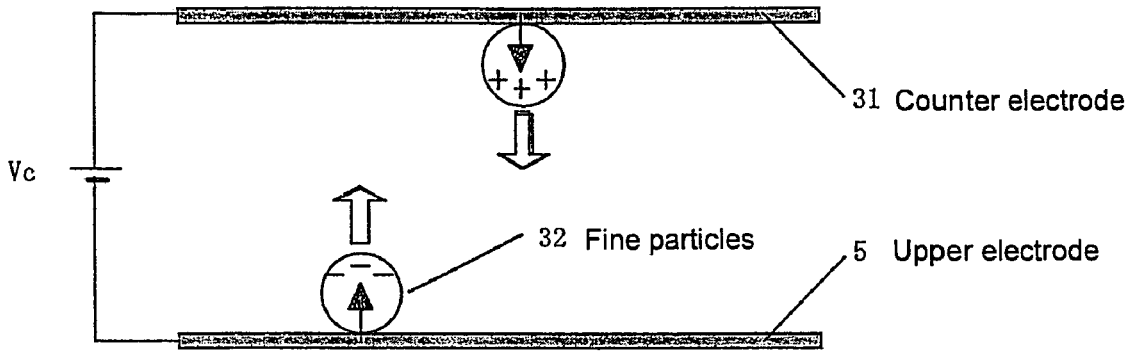
FIG. 9 explains induction charging of conductive particles.

This phenomenon will be described in more detail with reference to FIG. 9. If the DC voltage Vc is applied between the upper electrode 5 and the counter electrode 31, negative charges are injected into the conductive fine particles 32 attached onto the upper electrode 5 by an induction charging phenomenon. The maximum quantity of charges injected by this induction charging is expressed by the following Equation (3).

$$Q\ \max = 1.654\pi\cdot\in\cdot rt^2\cdot E \tag{3}$$

By way of example, it is assumed that the conductive fine particles each having a diameter of 8 μm are attached onto the upper electrode 5 and that the electric field intensity E is 1 MV/m. If these values are assigned to the Equation (3), the maximum quantity Qmax of charges which each of these conductive fine particles 32 obtains by the induction charging is "$-2.9\times10^{-15}$ C".

The electrostatic force Fe for peeling off the conductive fine particles 32 toward the counter electrode 31 acts on the conductive fine particles 32 thus negatively charged by the induction charging by the space electric field E generated between the upper electrode 5 and the counter electrode 31. If this electrostatic force Fe exceeds the image force Fi that is the adhesive force or the van der Waals' force Fv, then the conductive fine particles 32 fly toward the counter electrode 31 and the electron emitter 1 is cleaned.

Positive charges are then injected into the conductive fine particles 32 attached onto the counter electrode 31 by the induction charging phenomenon. As a result, the conductive fine particles 32 attached to the counter electrode 31 are positively charged, and the electrostatic force Fe for peeling off the conductive fine particles 32 toward the upper electrode 5 acts on the conductive fine particles 32 by the space electric field E generated between the upper electrode 5 and the counter electrode 31.

If the condition that this electrostatic force Fe exceeds the image force Fi that is the adhesive force by which the fine particles are attached to the counter electrode 31 or the van der Waals' force Fv is satisfied, the conductive fine particles 32 fly toward the upper electrode 5 and returned again onto the upper electrode 5.

As a result, the conductive fine particles 32 reciprocate between the upper electrode 5 and the counter electrode 31. This reciprocating time is determined by time for injecting charges into the fine particles 32, i.e., a resistance of the fine particles 32. Actually, however, fine particles 32 having various resistances are attached onto the upper electrode 5. It is therefore difficult to control the timing of turning off the voltage Vc, attract the fine particles 32 toward the counter electrode 5, and clean the electron emitter 1.

As shown in FIG. 8, if the surface of the counter electrode 31 is covered with the insulating layer, by contrast, it is possible to prevent injection of positive charges from the upper electrode 5 by the induction charging and, therefore, prevent the fine particles 32 from returning to the electron emitter 1.

If the electron emitter 1 is applied to the charging of the photoconductor for the electrophotographic process, then the photoconductor exhibits insulating property in the dark and the counter electrode 31 has therefore a two-layer structure of the metal electrode and the insulating layer. Consequently, it is possible to prevent the fine particles 32 from returning to the electron emitter 1 and clean the electron emitter 1.

If the fine particles attached to the upper electrode 5 are insulating fine particles similarly to the toner particles in the first embodiment, then it is necessary to drive the electron emitter 1 to negatively-charge the fine particles, apply a positive voltage to the counter electrode 51, and clean the electron emitter 1 by the electrostatic force Fe. If the attached fine particles are conductive as described in this embodiment, charges can be injected into the fine particles by the induction charging. Therefore, it is not always necessary to drive the electron emitter 1.

If the conductive fine particles are cleaned as described in this embodiment, the voltage applied to the counter electrode 51 may be either the positive voltage or the negative voltage. Namely, if the positive voltage is applied to the counter electrode 51, then negative charges are injected into the conductive fine particles, and the conductive fine particles are attracted toward the positive counter electrode 51 by the electrostatic force Fe. If the negative voltage is applied to the counter electrode 51, then positive charges are injected into the conductive fine particles, and the conductive fine particles are attracted toward the negative counter electrode by the electrostatic force Fe. It is noted however that it is necessary to provide the insulating layer 53 on the counter electrode 51 so as to prevent the conductive fine particles 32 moved toward the counter electrode 51 from returning to the electron emitter 1.

If the surface of the counter electrode 51 is formed from a semiconductive or insulating material, it is possible to prevent the conductive fine particles by the induction charging on the counter electrode 51 from returning to the electron emitter 1. However, if the electron emitter 1 is driven to operate, the counter electrode 51 is negatively charged up. Consequently, the electric field intensity in the external space is lessened, so that the insulating or conductive fine particles attached to the surface of the upper electrode 5 cannot be eliminated. To relax this unfavorable phenomenon as much as possible, the voltages Vps and Vc are controlled as follows.

When the electron emitter 1 is driven (the voltage Vps of 20 V is applied) so as to charge the fine particles attached to the surface of the upper electrode 5, a strong positive potential is not applied to the counter electrode 51 (Vc=100 V), thereby preventing the surface of the counter electrode 5 from being negatively charged as much as possible.

When the fine particles attached to the surface of the upper electrode 5 is eliminated, a strong positive voltage is applied to the counter electrode 51 (Vc=1000 V) so as to prevent the electron emitter 1 from further operating, thereby preventing the surface of the counter electrode 5 from being negatively charged up. As a result of controlling the driving of the electron emitter 1 and the electric field in the external space at such timings, it is possible to apply the electric field intensity necessary to eliminate the insulating or conductive fine particles and thus efficiently eliminate the fine particles.

As described above, by driving the electron emitter 1 to operate, the fine particles can be negatively charged. Therefore, the relationship of "Fi<Fe" can be satisfied for the fine particles having strong positive charges, weak positive charges, no charges, or weak negative charges, and the fine particles can be thereby eliminated. However, if the insulating fine particles having quite strong negative charges are attached onto the upper electrode 5, then the image force Fi exceeds the electrostatic force Fe for cleaning as shown in FIG. 7, and the fine particles cannot be eliminated by the electrostatic force.

During the electrophotographic process, a floating ratio of the fine particles having weak positive charges, no positive charges, or weak negative charges is high. In addition, there is a high probability that the fine particles having positive charges by the electric field in the external space by the DC voltage Vc in a charging operation are attached onto the upper electrode 5.

In a non-charging operation, the electric field in the external space is eliminated, so that the insulating fine particles having strong negative charges and present with low probability may possibly be attached onto the upper electrode 5.

Therefore, even in the non-charging operation in which the voltage Vps is turned off, the low voltage Vc is applied and set so that the upper electrode 5 serves as the negative electrode. It is thereby possible to prevent the insulating fine particles having strong negative charges from being attached onto the upper electrode 5 and to extend the life of the electron emitter 1. Since no current is carried at the time of applying the low DC voltage, power loss hardly occurs.

The electron emission device using the porous polysilicon layer has been described so far. However, the present invention is not limited to the electron emitter using the porous polysilicon layer that serves as an electron acceleration layer but is also applicable to a surface emission type electron emitter such as MIM or MIS electron emitter.

As described in the embodiments, the electron emission device of the present invention is also applicable to an instance of using the (n type) silicon substrate and to an instance of using the glass substrate. Accordingly, the type of the substrate may be determined according to the purpose of the device or in light of the following merits and demerits of the substrate to be used.

If the (n type) silicon substrate is used, the silicon substrate is superior to the glass substrate in smoothness and material affinity, and a semiconductor film can be formed on the substrate more easily. In addition, the silicon substrate has excellent heat resistance, various heat treatments such as thermal oxidation can be conducted. However, material cost is comparatively high, so that it is difficult to apply the silicon substrate to a large-sized substrate.

If the glass substrate is used, material cost is lower than that of the silicon substrate and the glass substrate can be applied to the large-sized substrate more easily than the silicon substrate. However, the glass substrate is inferior to the silicon substrate in heat resistance, so that various heat treatments such as thermal oxidation are restricted.

The electron emission device according to the present invention can clean the fine particles on the metal thin film on the surface of the upper electrode of the electron emitter in a non-contact manner. It is therefore possible to solve the problems of the damage and peel-off of the metal thin film due to the friction or stress, as compared with the apparatus that performs contact cleaning.

Further, by controlling the applied voltages to be changed between the operation of charging the fine particles attached to the electron emitter and the operation of causing the fine particles to fly, it is possible to avoid the dielectric breakdown in the air caused by the discharge which breakdown occurs if the device operates in the air, and avoid the breakdown of the electron emitter by the discharge. By setting the charging electric field intensity to be equal to or lower than 3 MV/m, in particular, the discharge can be effectively prevented.

Further, by controlling the voltage applied to separate the fine particles attached to the electron emitter from the electron emitter to be applied as the pulsed voltage, the attached fine particles can be effectively eliminated.

By forming the surface of the counter electrode from the semiconductive or insulating material, it is possible to prevent positive charges from being injected into the conductive or semiconductive fine particles moved toward the counter electrode. It is therefore possible to prevent the phenomenon that the fine particles attracted once from the surface of the electron emitter toward the counter electrode are moved again to the surface of the electron emitter.

If the surface of the counter electrode is formed from the semiconductive or insulating material, the high voltage is not applied between the upper electrode and the counter electrode while the electron emitter operates. If a high positive voltage is applied to the counter electrode to cause the charged fine particles attached on the surface of the emitter to fly toward the positive electrode side, the electron emitter is not driven to operate. It is thereby possible to prevent charge up the counter electrode. Accordingly, it is possible to prevent the electric field between the upper electrode and the counter electrode from being lessened and prevent the fine particle elimination effect from weakening.

By making the polarity of the voltage between the upper electrode and the counter electrode arbitrarily settable, the fine particles can be eliminated from the electron emitter irrespective of the charge polarity of the fine particles (whether the fine particles are positively charged or negatively charged).

By employing, as the semiconductor layer, the porous silicon semiconductor layer obtained by making part of the polysilicon layer porous, thermal stability of the electron emitter is improved and stable electron emitting operation can be ensured.

Additionally, by applying the voltage so that the upper electrode on the surface of the electron emitter is negative relative to the counter electrode even in the non-charging operation in which the DC voltage Vps to be applied between the upper electrode and the lower electrode is turned off, it is possible to prevent the insulating fine particles having strong negative charges, which are difficult to clean, from being attached to the surface of the electron emitter. The long life of the electron emitter can be thereby ensured.

The invention claimed is:

1. A method for cleaning fine particles from an electron emission device comprising:

an electron emitter including a lower electrode, an upper electrode made of a thin film, and a semiconductor layer formed between the lower electrode and the upper electrode, a surface of the upper electrode being exposed to an external space;

a counter electrode disposed opposite the upper electrode across the external space;

first voltage control means for selectively applying between the lower and upper electrodes (i) an electron emitting voltage having a polarity for accelerating electrons in the semiconductor layer such that the accelerated electrons are passed through the upper electrode and emitted to the external space, (ii) a predetermined voltage for charging fine particles adhered to the surface of the upper electrode, (ii) a voltage of opposite polarity to the polarity of the electron emitting voltage, or (iv) no voltage; and second voltage control means for selectively applying at least one voltage between the upper electrode and the counter electrode having a predetermined relationship to the voltage applied between the lower and upper electrodes by the first voltage control means;

said method comprising the steps of:

applying the predetermined voltage for charging fine particles adhered to the surface of the upper electrode between the upper electrode and the lower electrode while at the same time applying a voltage having a predetermined relationship to the voltage applied between the upper electrode and the lower electrode between the upper electrode and the counter electrode for a period sufficient for the fine particles adhered to the surface of the upper electrode to assume a predetermine level of charge;

thereafter, applying a voltage for causing the charged fine particles to fly toward the counter electrode from the upper electrode between the upper electrode and the counter electrode without atmospheric discharge while at the same time applying between the upper and lower electrodes either no voltage or a voltage of opposite polarity to the polarity of the voltage then being applied between the upper electrode and the counter electrode; and thereafter, applying between the upper electrode and the lower electrode an electron emitting voltage for accelerating electrons in the semiconductor layer such that the accelerated electrons are passed through the upper electrode and emitted to the external space while at the same time applying a voltage having a predetermined relationship to the voltage then being applied between the upper electrode and the lower electrode so as to convey the emitted electrons toward the counter electrode through the external space.

2. The method according to claim 1, wherein the semiconductor layer is a porous polysilicon semiconductor layer in which a part or all of the polysilicon is made porous.

3. The method according to claim 1, wherein the counter electrode has a semiconductive layer or an insulating layer formed on a surface thereof facing the upper electrode.

4. The method according to claim 1, wherein the second voltage control means applies a pulsed voltage so that the counter electrode has a positive potential relative to the upper electrode during the period when the first control means applies either no voltage or a voltage of a polarity opposite to that of the voltage applied between the upper electrode and the counter electrode between the upper electrode and the lower electrode.

5. The method according to claim 1, wherein the voltages applied by the first voltage control means and by the second voltage control means are related to one another such that:

during the application of the predetermined voltage between the upper electrode and the lower electrode so as to charge the fine particles adhered to the surface of the upper electrode by the first voltage control means, the second voltage control means applies a voltage having a first value; and thereafter, the second voltage control means applies a voltage having a second value higher than the first value between the upper electrode and the counter electrode.

6. The method according to claim 1 wherein the second voltage control means applies a voltage between the upper electrode and the counter electrode when the electrons are not emitted from the electron emitter such that the surface of the upper electrode of the electron emitter is negative.

7. The method according to any one of claims 1-6, for use in a laser printer or a digital copying machine that includes an electron emission device.

8. The method according to any one of claims 1-6, wherein the fine particles include dust such as toner and paper particles.

* * * * *